US009362044B1

(12) United States Patent
Folker et al.

(10) Patent No.: US 9,362,044 B1
(45) Date of Patent: Jun. 7, 2016

(54) MAGNETIC COMPONENT WITH MULTIPLE PIN ROW BOBBIN

(71) Applicant: Universal Lighting Technologies, Inc., Madison, AL (US)

(72) Inventors: Donald Folker, Madison, AL (US); Mike LeBlanc, Huntsville, AL (US); Deborah Pinkerton, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 119 days.

(21) Appl. No.: 14/185,408

(22) Filed: Feb. 20, 2014

Related U.S. Application Data

(60) Provisional application No. 61/772,379, filed on Mar. 4, 2013.

(51) Int. Cl.

| | |
|---|---|
| ***H01F 27/29*** | (2006.01) |
| ***H01F 27/30*** | (2006.01) |
| ***H01F 27/02*** | (2006.01) |
| ***H01F 27/06*** | (2006.01) |

(52) U.S. Cl.
CPC ..... *H01F 27/292* (2013.01); *H01F 27/06* (2013.01); *H01F 2027/065* (2013.01); *H01F 2027/297* (2013.01)

(58) Field of Classification Search
CPC ..... H01F 5/04; H01F 27/292; H01F 1/10; H01F 27/29; H01F 27/027; H01F 2007/062; H01F 2005/043
USPC ..... 336/192, 65, 198
See application file for complete search history.

(56) References Cited

U.S. PATENT DOCUMENTS

| | | | | |
|---|---|---|---|---|
| 5,008,644 | A * | 4/1991 | Cooper | 336/192 |
| 6,559,749 | B1 * | 5/2003 | Weiner | 336/192 |
| 6,781,499 | B2 * | 8/2004 | Steiner | 336/192 |
| 7,515,026 | B1 * | 4/2009 | Liu et al. | 336/192 |
| 2002/0017975 | A1 * | 2/2002 | Chiang et al. | 336/198 |
| 2002/0070833 | A1 * | 6/2002 | Junjie et al. | 336/198 |
| 2003/0030531 | A1 * | 2/2003 | Okano et al. | 336/198 |
| 2006/0125592 | A1 * | 6/2006 | Fushimi | H01F 5/02 336/208 |
| 2007/0194875 | A1 * | 8/2007 | Wang | H01F 27/027 336/199 |
| 2008/0100407 | A1 * | 5/2008 | Yamaguchi | H01F 5/04 336/192 |
| 2009/0278646 | A1 * | 11/2009 | Chen et al. | 336/177 |
| 2010/0253458 | A1 * | 10/2010 | Chen et al. | 336/170 |
| 2011/0043315 | A1 * | 2/2011 | Kobayashi et al. | 336/192 |
| 2011/0102119 | A1 * | 5/2011 | Tsai et al. | 336/192 |
| 2011/0221559 | A1 * | 9/2011 | Tsai et al. | 336/192 |

* cited by examiner

*Primary Examiner* — Elvin G Enad
*Assistant Examiner* — Kazi Hossain
(74) *Attorney, Agent, or Firm* — Patterson Intellectual Property Law, P.C.; Mark J. Patterson; Gary L. Montle

(57) ABSTRACT

A magnetic component apparatus includes a bobbin having a bobbin body, a first pin rail, a second pin rail, and a longitudinal axis. First and second pin rows are located on the first pin rail. The second pin row is located at an exterior position from the first pin row. A third pin row is located on the second pin rail. The first, second, and third pin rows can be oriented in a direction transverse to the longitudinal axis. A plurality of windings can be located on the bobbin body. Some embodiments can include a fourth pin row located on the second pin rail, the fourth pin row located at an exterior position from the third pin row. In some embodiments one or more wire guide channels can be defined in the first or second pin rails to help keep breakout wires from the plurality of windings separate.

20 Claims, 9 Drawing Sheets

MAGNETIC COMPONENT WITH MULTIPLE PIN ROW BOBBIN

CROSS-REFERENCES TO RELATED APPLICATIONS

This application claims benefit of the following patent application which is hereby incorporated by reference: MAGNETIC COMPONENT WITH DUAL PIN ROW BOBBIN, Application Ser. No. 61/772,379 filed Mar. 4, 2013.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates generally to magnetic components for electronic circuits in which the component includes multiple wire windings on a bobbin and a core inserted through the bobbin. The bobbin may have one or more pins to which the windings may be connected The magnetic component may be used as a transformer to couple, distribute, balance or allocate power among different windings on the bobbin.

More particularly, the present invention pertains to a magnetic component apparatus having a large number of windings on a bobbin and a large number of pins on the bobbin to which the windings are to be connected.

Conventional bobbins for magnetic components typically have two pin rails with each rail having multiple pins. Conventional bobbins may have a single row of pins on each pin rail. The problem with such a configuration is that as more windings are added to the bobbin, and therefore more pins are added to the end of the row of pins, the bobbin must necessarily be made wider to accommodate the additional pins. A wider bobbin may also require a wider core. A wider bobbin may also require more insulation material to conform to applicable product safety standards. As such, the overall size as well as the material cost to make the bobbin can increase as more pins are added. This is undesirable because for many applications, space is limited, and a larger magnetic component would be cumbersome and consume valuable space.

What is needed, then, are improvements in a magnetic component apparatus having multiple windings and multiple pins.

BRIEF SUMMARY OF THE INVENTION

The present invention includes a magnetic component apparatus having multiple windings on a bobbin and multiple pins on the bobbin to which the multiple windings may be connected.

One aspect of the invention is a magnetic component apparatus including a core. The core can be inserted through a bobbin having a bobbin body, a first pin rail, a second pin rail, and a longitudinal axis. The core may be inserted through the bobbin along a longitudinal axis. The first pin rail can have a first inner side and the second pin rail can have a second inner side. A first pin row can be located on the first pin rail. A second pin row can also be located on the first pin rail, the second pin row located at a longitudinally exterior position from the first pin row. A third pin row can be located on the second pin rail. The first, second, and third pin rows can be oriented in a direction substantially transverse to the longitudinal axis. A plurality of windings can be located on the bobbin body between the first pin rail and the second pin rail.

Another aspect of the present invention is a magnetic component apparatus having a bobbin which includes a bobbin body having a first end, a second end, and a longitudinal axis. The bobbin further includes a first pin rail located on the first end of the bobbin body and a second pin rail located on the second end of the bobbin body. The first pin rail has a first inner side and the second pin rail has a second inner side. A first pin row can be located on the first pin rail. A second pin row can also be located on the first pin rail, the second pin row located at a longitudinally exterior position from the first pin row. At least a third pin row can be located on the second pin rail. A plurality of windings can be located on the bobbin body.

A third aspect of the present invention is a magnetic component including a core and a bobbin disposed on the core. The bobbin can include a bobbin body, a first pin rail, and a second pin rail. A first pin row can be located on the first pin rail. A second pin row can also be located on the first pin rail, the second pin row located at an exterior position from the first pin row on the first pin rail. At least a third pin row can be located on the second pin rail. A plurality of windings can be located on the bobbin body. A printed circuit board can be electrically connected to the first, second, and third pin rows.

In the embodiments described above, the magnetic component apparatus can further include a fourth pin row located on the second pin rail. The fourth pin row can be located at a longitudinally exterior position from the third pin row. Additionally, in some embodiments a first wire guide channel can be defined in the first inner side of the first pin rail, the first wide guide channel extending between the first pin row toward the second pin row. A second wire guide channel can be defined in the second inner side of the second pin rail. The second wire guide channel can extend between the third pin row toward the fourth pin row.

One object of the present invention is to provide a magnetic component apparatus having multiple windings and multiple pins.

Another object of the present invention is to provide a magnetic component which is capable of being manufactured with minimal overall size.

A further object of the present invention is to provide a magnetic component including one or more wire guide channels which can help separate multiple breakout wires from a plurality of windings.

DETAILED DESCRIPTION OF THE INVENTION

While the making and using of various embodiments of the present invention are discussed in detail below, it should be appreciated that the present invention provides many applicable inventive concepts that is embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims. Numerical terms such as first, second, third, etc. as used herein are meant to help identify different aspects of the embodiments, but their usage does not delimit the scope of the invention, except as set forth in the claims.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The term "when" is used to specify orientation for relative positions of components, not as a temporal limitation of the claims or apparatus described and claimed herein unless otherwise specified.

The present invention provides an apparatus for a magnetic component that can be used in an electric circuit. The magnetic component apparatus includes multiple windings and multiple pins.

Figure 1:
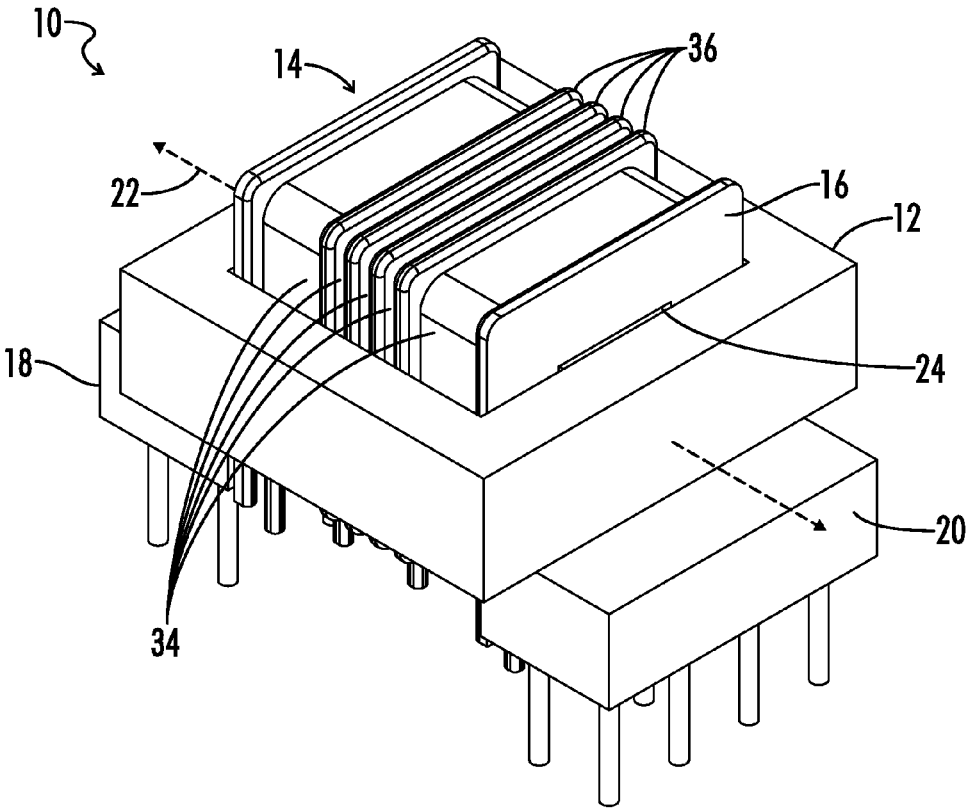
FIG. 1 is a perspective view of one embodiment of a magnetic component apparatus according to the present invention.

A perspective view of one embodiment of a magnetic component apparatus 10 is shown in FIG. 1. Magnetic component apparatus 10 includes a core 12. A bobbin 14 is disposed on core 12. Bobbin 14 can include a bobbin body 16, first pin rail 18, second pin rail 20, and longitudinal axis 22 defined along the apparatus 10. Bobbin body 16 can have passage 24 extending along longitudinal axis 22 through bobbin body 16. Core 12 can then be inserted through bobbin body 16 through passage 24.

Figure 2:
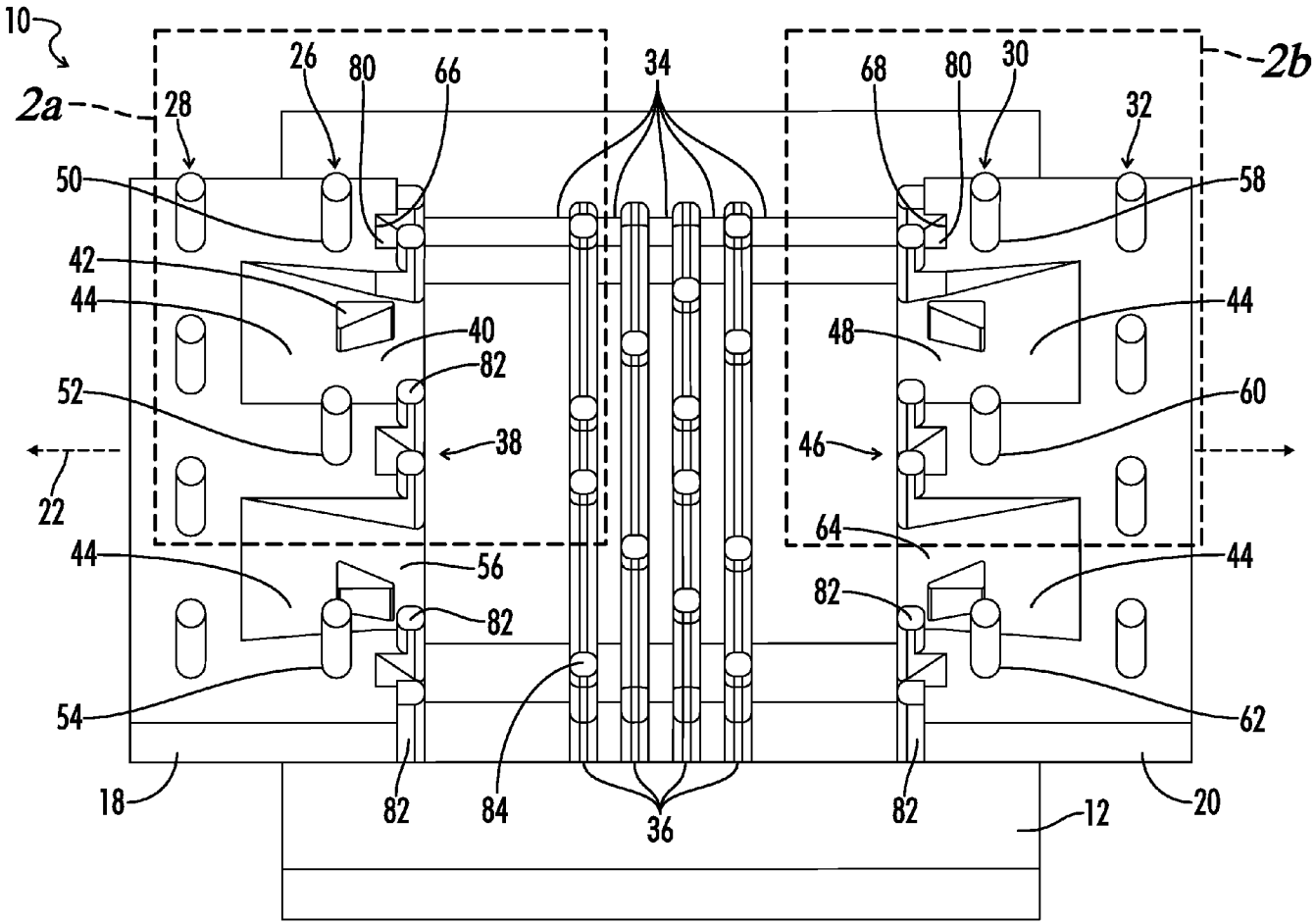
FIG. 2 is a bottom side perspective view of the magnetic component apparatus of FIG. 1.

A bottom side perspective view of the embodiment shown in FIG. 1 is seen in FIG. 2. A first pin row 26 can be located on first pin rail 18. A second pin row 28 can also be located on first pin rail 18. Second pin row 28 can be located at a longitudinally exterior position from first pin row 26 on first pin rail 18. Magnetic component 10 can also include a third pin row 30 located on second pin rail 20. First, second, and third pin rows 26, 28, 30 can be oriented in a direction substantially transverse to longitudinal axis 22.

In some embodiments a fourth pin row 32 can be located on second pin rail 20. Fourth pin row 32 can be located at a longitudinally exterior position from third pin row 30. As such, both first pin rail 18 and second pin rail 20 can include two pin rows.

Having more than one pin row on one or more pin rails can help reduce the overall size and cost of magnetic component apparatus 10. With a single pin row on a pin rail, as the number of pins required is increased, the pins had to be added to the end of the pin row. The width and overall size of the magnetic component can necessarily increase to accommodate the extra pins. Having an additional pin row on a pin rail can allow additional pins to be added to the magnetic component apparatus 10 while decreasing the amount of added material that may be necessary to accommodate the additional pins. Thus, the use of more than one pin row can decrease the size of core 12 and bobbin 14 compared to conventional models. Additionally, a smaller core and bobbin size also requires less insulation material to keep magnetic component 10 compliant with safety standards. This can help minimize the overall cost and size of magnetic component 10, which can be of significant importance in many applications in which magnetic component 10 can be used where space is limited, including many electrical applications.

A pin row can be defined as a row of at least two pins. In some embodiments, as shown in FIG. 2, first pin row 26 can include at least three pins, and second pin row 28 can include at least four pins. Thus, a total of at least seven pins can be located on first pin rail 18 which can provide at least seven electrical connection points. In additional embodiments, third pin row 30 can include at least three pins, and fourth pin row 32 can include at least four pins.

Referring again to FIG. 1, magnetic component apparatus 10 can include a plurality of windings 34 located on bobbin body 16 between first pin rail 18 and second pin rail 20. The windings 34 can be configured as multi-layered windings, or the windings in plurality of windings 34 can be separated by one or more central flanges 36 located on bobbin body 16. In additional embodiments, windings 34 can include a combination of multi-layered windings and single windings separated by one or more central flanges 36. Windings 34 can include breakout wires which can be electrically connected to pins on first, second, third, or fourth pin rows 26, 28, 30, 32.

Referring again to FIG. 2, first pin rail 18 can further include a first inner side 38. First inner side 38 can substantially face windings 34. A first wire guide channel 40 can be defined in first inner side 38. First wire guide channel 40 can extend between first pin row 26 towards second pin row 28. First wire guide channel 40 can be a blind channel, as shown in FIG. 2. In additional embodiments, first wire guide channel 40 can be a clearance channel. First wire guide channel can help provide access for the breakout wires of windings 34 to second pin row 28.

First wire guide channel 40 can be a long, narrow channel which can be configured to receive one of the breakout wires from windings 34. Additionally, as seen in FIG. 2, first wire guide channel 40 can be a wider channel which can be configured to receive multiple breakout wires from windings 34. In some embodiments, first wire guide channel 40 can include a divider 42 which can help separate multiple breakout wires being run through first wire guide channel 40.

Additionally, in some embodiments, second pin rail 20 can have a second inner side 46. A second wire guide channel 48 can then be defined in second inner side 46. Second wire guide channel 48 can extend between third pin row 30 toward fourth pin row 32. The features of second wire guide channel 48 can be similar to the features of first wire guide channel 40 as previously described above.

In some embodiments, first pin row 26 can include first pin 50, second pin 52, and third pin 54. First wire guide channel 40 can extend between first pin 50 and second pin 52 toward second pin row 28. A third wire guide channel 56 can be further defined in first inner side 38 of first pin rail 18. Third wire guide channel 56 can extend between second and third pins 52 and 54 toward second pin row 28. Multiple wire guide channels in first pin rail 18 can help provide multiple points of access for breakout wires from plurality of windings 34 being connected to second pin row 28.

Similarly, third pin row 30 on second pin rail 20 can include fourth pin 58, fifth pin 60, and sixth pin 62. Second wire guide channel 48 can extend between fourth and fifth pin 58 and 60 toward fourth pin row 32. A fourth wire guide channel 64 can be further defined in second inner side 46. Fourth wire guide channel 64 can extend between fifth and sixth pin 60 and 62 toward fourth pin row 32. As such, multiple wire guide channels in second pin rail 20 can help provide multiple points of access for breakout wires in windings 34 being connected to fourth pin row 32.

In some embodiments, a first wire guide groove 66 can be defined in first inner side 38 of first pin rail 18. First wire guide groove 66 can extend toward first pin row 26. A second wire guide groove 68 can be defined in second inner side 46 of second pin rail 20. Second wire guide groove 68 can extend toward third pin row 30.

Figure 2A:
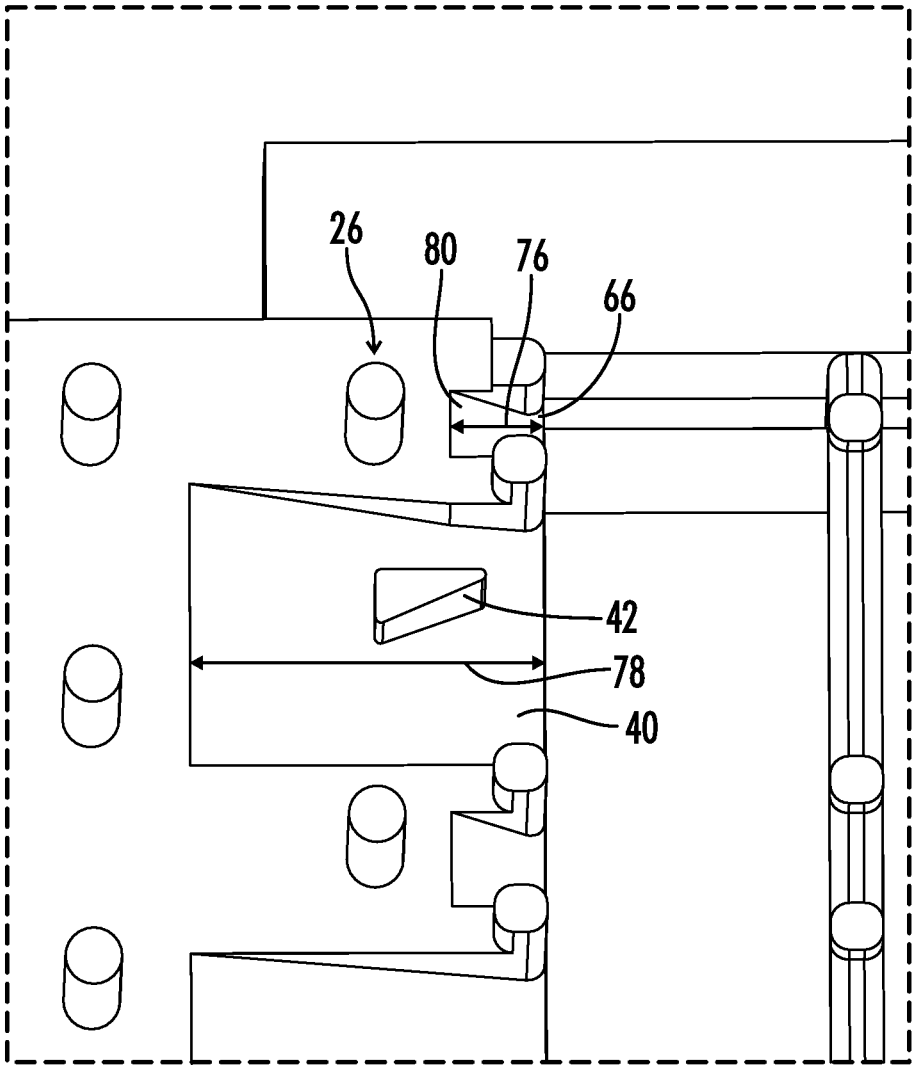
FIG. 2*a* is a slightly rotated detailed view of a wire guide channel and a wire guide groove shown in a first pin rail of the magnetic component apparatus of FIG. 2.
Figure 2B:
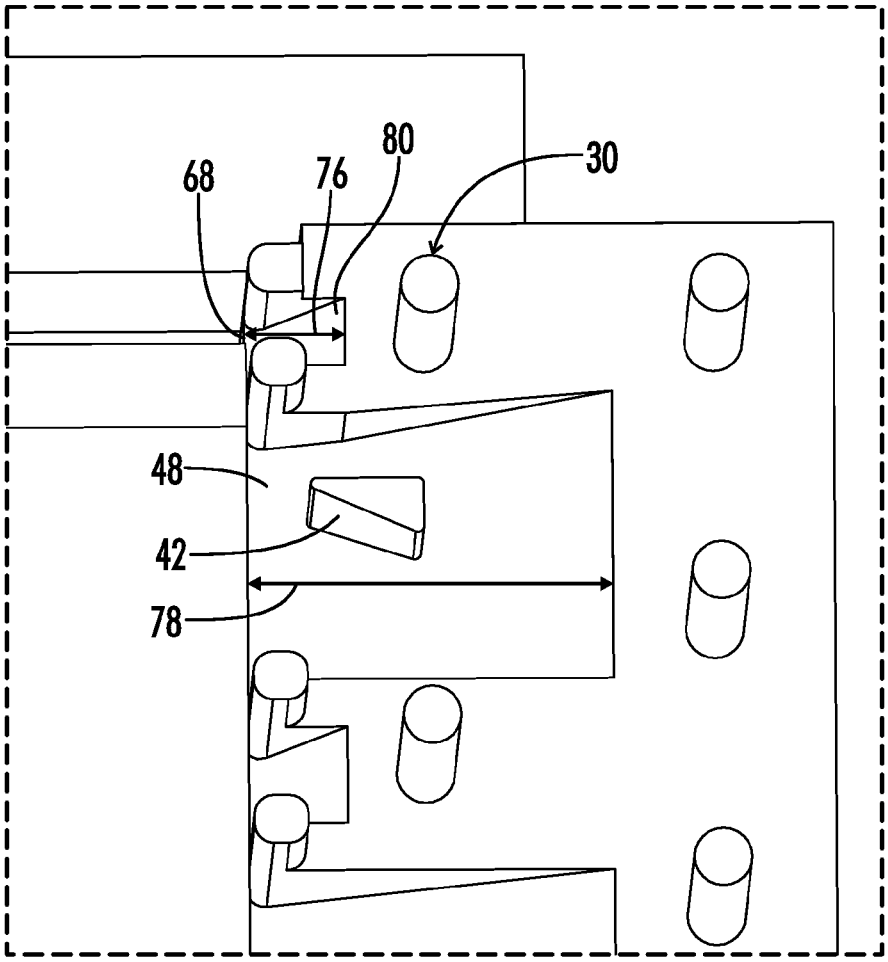
FIG. 2*b* is another slightly rotated detailed view of a wire guide channel and a wire guide groove shown in a second pin rail of the magnetic component apparatus of FIG. 2

In some embodiments as seen in FIG. 2, one or more of the wire guide channels 40, 48, and 56, 64 can have a floor 44 that is inclined towards second pin row 28 and fourth pin row 32 respectively. Wire being positioned in the wire guide channels can be gradually led up to second pin row 28 and fourth pin row 32. As such, wire guide channels 40, 48, 56, and 64 can function as ramps for wire leading to second pin row 28 and fourth pin row 32. In other embodiments, floor 44 of one or more of wire guide channels 40, 48, 56, and 64 can be flat or level such that rectangular channels can be formed. Similarly, as seen in FIG. 2*a* and FIG. 2*b*, one or more of wire guide grooves 66 and 68 can have a floor 80 that is inclined toward first and third pin row 26 and 30 respectively. Wire positioned in wire guide grooves 66 and 68 can be gradually led up to first pin row 26 or third pin row 30 respectively. As such, wire guide grooves 66 and 68 can act as ramps for wire leading to first pin row 26 and third pin row 30 respectively. In other embodiments, wire guide grooves 66 and 68 can have floors 80 that are flat or level such that rectangular grooves can be formed.

In some embodiments, as shown in FIG. 2, multiple wire guide grooves can be defined in the first inner side 38 and the second inner side 46 so that a wire guide groove can extend toward each of the pins in the first pin row 26 and the third pin row 30 respectively. Additionally, multiple wire guide channels can be defined in the first inner side 38 and the second inner side 46 so that a wire guide channel can extend between each set of adjacent pins in the first pin row 26 and the third pin row 30 respectively.

Thus, wire guide channels 40, 48, 56, and 64 previously mentioned can facilitate access to second and fourth pin rows 28 and 32, while wire guide grooves 66 and 68 can help provide access to first and third pin rows 26 and 30. As can be seen in FIG. 2*a* and FIG. 2*b*, wire guide grooves 66 and 68 can also have a smaller depth 76 than the depth 78 of wire guide channels 40, 48, 56, and 64 because the wire guide grooves extend toward the first and third pin rows 26 and 30 while the wire guide channels extend toward the second and fourth pin rows 28 and 32. The use of the wire guide channels and the wire guide grooves also can help maintain separation between breakout wires and windings 34 being connected to different pins on the first, second, third, and fourth pin rows. Such separation can help reduce the potential for short circuiting or interference between breakout wires. Such separation can also make magnetic component 10 easier and quicker to wire as breakout wires remain separate and distinct from one another.

In some embodiments, first inner side 38 of first pin rail 18 and second inner side 46 of second pin rail 20 can include a plurality of wire guide posts 82 (FIG. 2). Wire guide posts 82 can help direct the breakout wires into the proper wire guide channel or wire guide groove to be connected to the proper pin on the first or second pin rails 18 and 20. Additionally, one or more central flanges 36 can include a plurality of winding guide posts 84. The winding guide posts guide the breakout wires as they exit the windings and the central flanges and can be used to direct the breakout wires toward the proper pin on the first or second pin rails 18 and 20.

Figure 4:
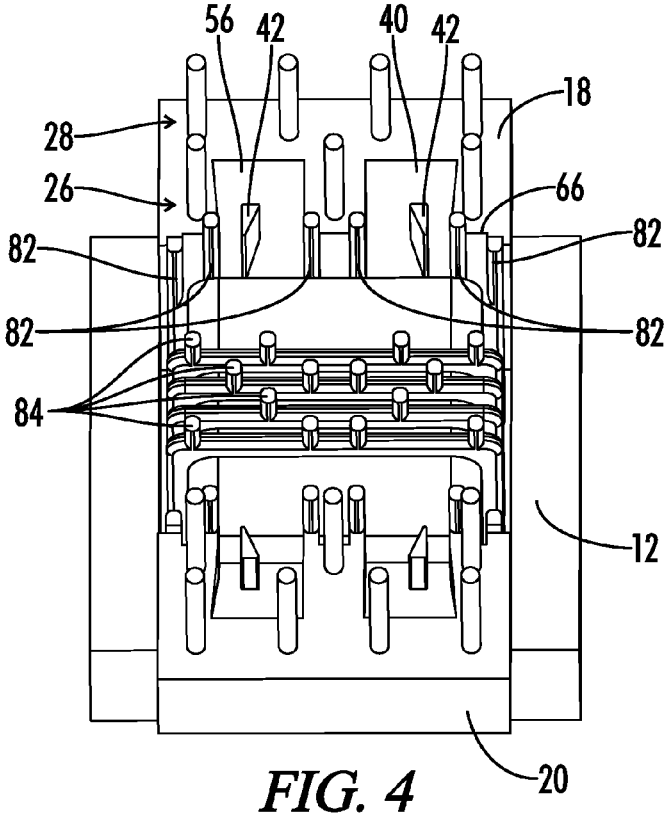
FIG. 4 is a bottom end perspective view of the magnetic component apparatus of FIG. 1.

A bottom end perspective view of magnetic component 10 of FIG. 1 is shown in FIG. 4. From FIG. 4, it can be seen that wire can be inserted between guide posts 82 into the proper wire guide channel or wire guide groove. Wire inserted into the multiple wire guide grooves can lead to the pins on the first pin row 26, and wire inserted into wire guide channels 40 and 56 can lead to the pins on the second pin row 28. Multiple wires inserted into wire guide channels 40 and 56 can also be separated by dividers 42 located in the wire guide channels 40 and 56, wire being positioned on either side of dividers 42.

Figure 3:
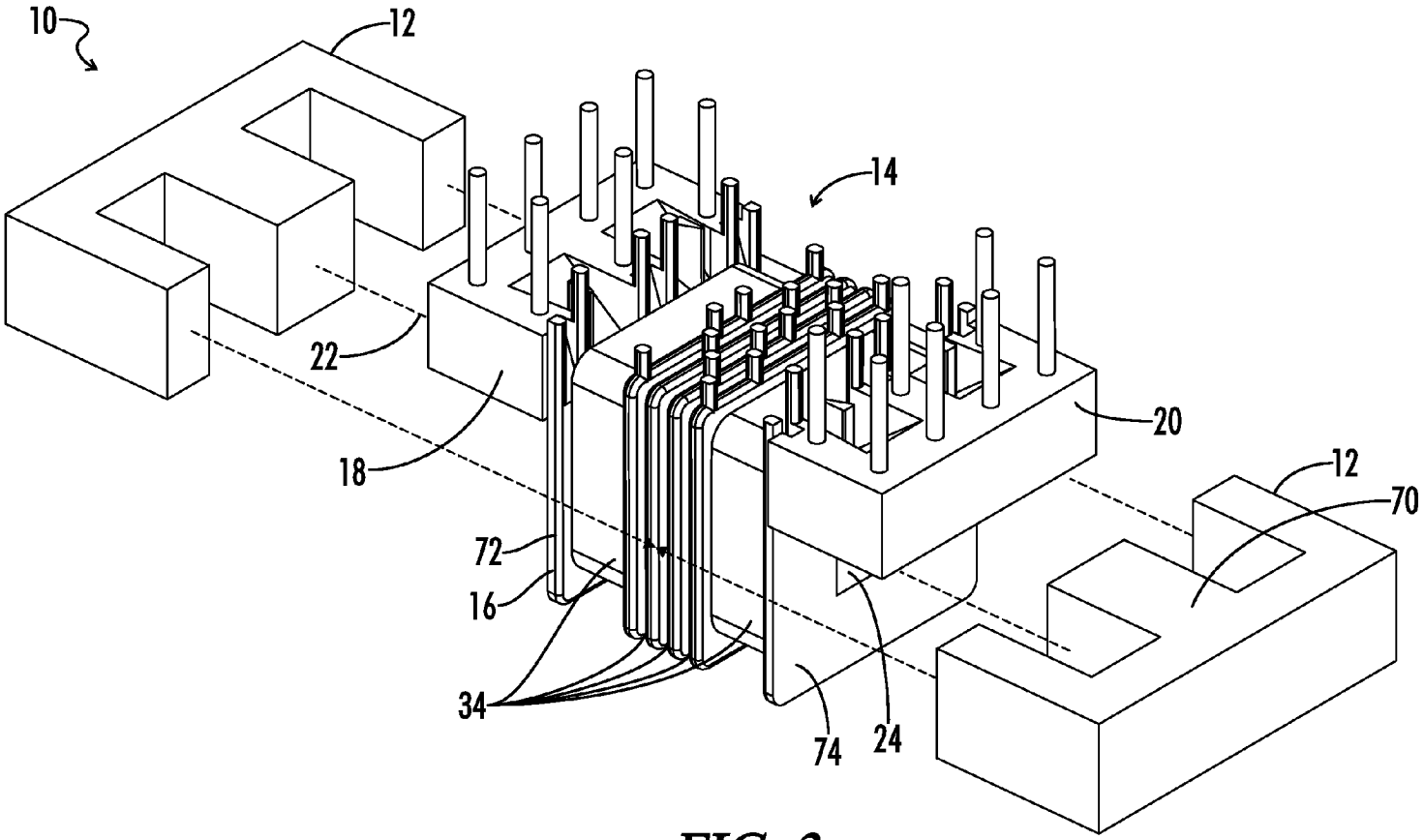
FIG. 3 is a perspective exploded view of the magnetic component apparatus of FIG. 1.

An exploded view of magnetic component 10 of FIG. 1 is shown in FIG. 3. Core 12 is depicted as a double E-core having a middle leg 70 that can be inserted through passage 24 in the bobbin body 16. In other embodiments, the core 12 can be any suitable core shape, including but not limited to I-cores, E-cores, C-cores, U-cores, toroidal cores, or any combination thereof.

Bobbin body 16 can have a first end 72 and a second end 74. First pin rail 18 can be located on first end 72 of bobbin body 16, and second pin rail 20 can be located on second end 74 of bobbin body 16. As such, windings 34 located on bobbin body 16 can be between first and second pin rails 18 and 20 so that the windings 34 can be connected across first and second pin rails 18 and 20.

Figure 5:
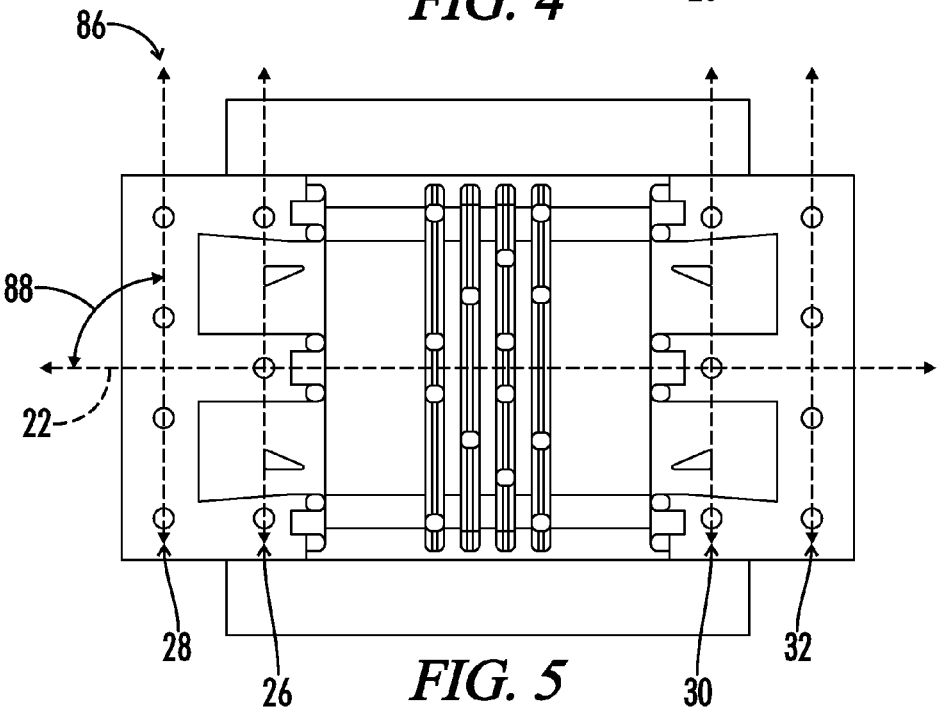
FIG. 5 is a bottom view of the magnetic component apparatus of FIG. 1.

A bottom view of magnetic component apparatus 10 of FIG. 1 is shown in FIG. 5. First, second, third and fourth pin rows 26, 28, 30, and 32 can be oriented in a direction 86 substantially transverse to longitudinal axis 22, and form an angle 88 with longitudinal axis 22. In some embodiments, all pin rows can be oriented to form substantially the same angle 88 with longitudinal axis 22. Thus, the pin rows can be substantially parallel to one another. In other embodiments, angle 88 formed between longitudinal axis 22 and different pin rows can vary such that the pin rows are not parallel to one another. In some embodiments, angle 88 can be about 90 degrees such that the pin rows are substantially perpendicular to longitudinal axis 22. In other embodiments, angle 88 can range from about 60 degrees to about 90 degrees.

Figure 6:
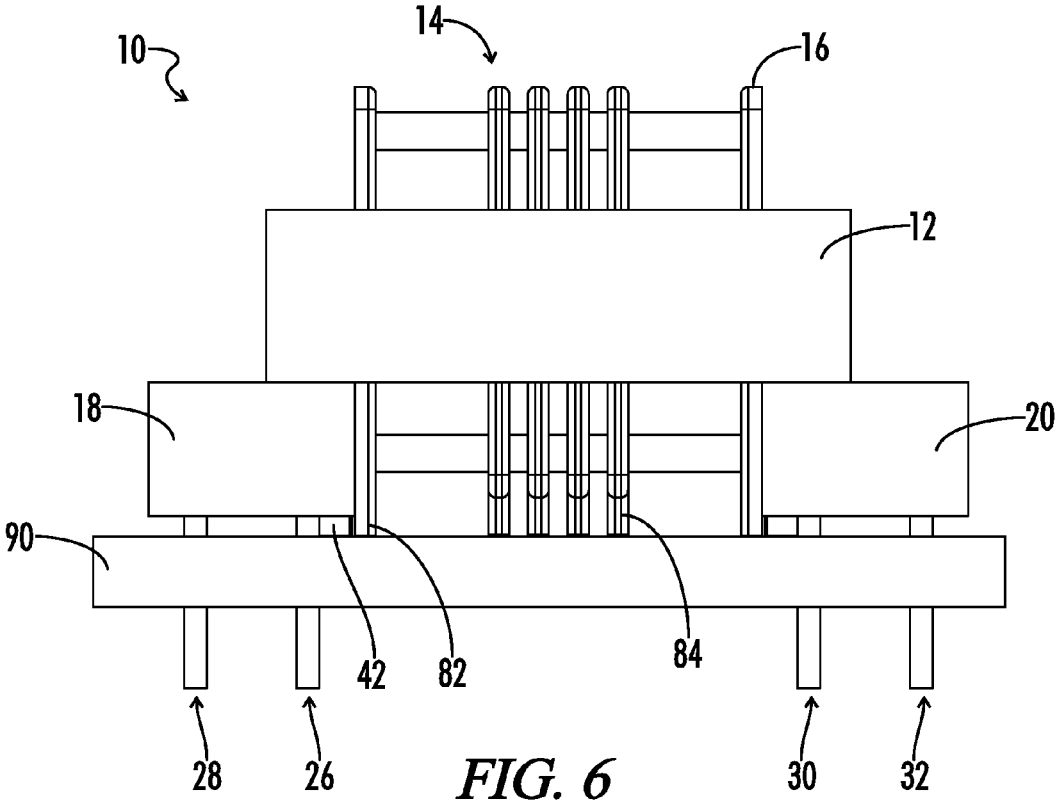
FIG. 6 is a side elevation view of an embodiment of a magnetic component apparatus according to the present invention, including a printed circuit board.

In an additional embodiment of the present invention, as shown in FIG. 6, magnetic component apparatus 10 can include a printed circuit board 90 electrically connected to first, second, third, and fourth pin rows 26, 28, 30, and 32. Printed circuit board 90 can have electrical connection ports that can receive the pins on the first and second pin rails 18 and 20. Printed circuit board 90 can then control electric current provided to windings 34 on magnetic component apparatus 10.

In some embodiments, printed circuit board 90 can be configured to receive wire guide posts 82 so that wire guide posts 82 thereby support bobbin 14 on printed circuit board 90 and alleviate stress on the first, second, third, and fourth pin rows 26, 28, 30, and 32. Additionally, in some embodiments, winding guide posts 84 as well as dividers 42 can butt against printed circuit board 90 after pins on bobbin 14 have been inserted into printed circuit board 90 a predetermined distance. As such, winding guide posts 84 and dividers 42 can act as stops against printed circuit board 90 and can be configured to leave a gap between first and second pin rails 18 and 20 and printed circuit board 90. Such a gap can help increase circulation and ventilation around the pins and printed circuit board 90 when power is being supplied to plurality of windings 34.

Figure 7:
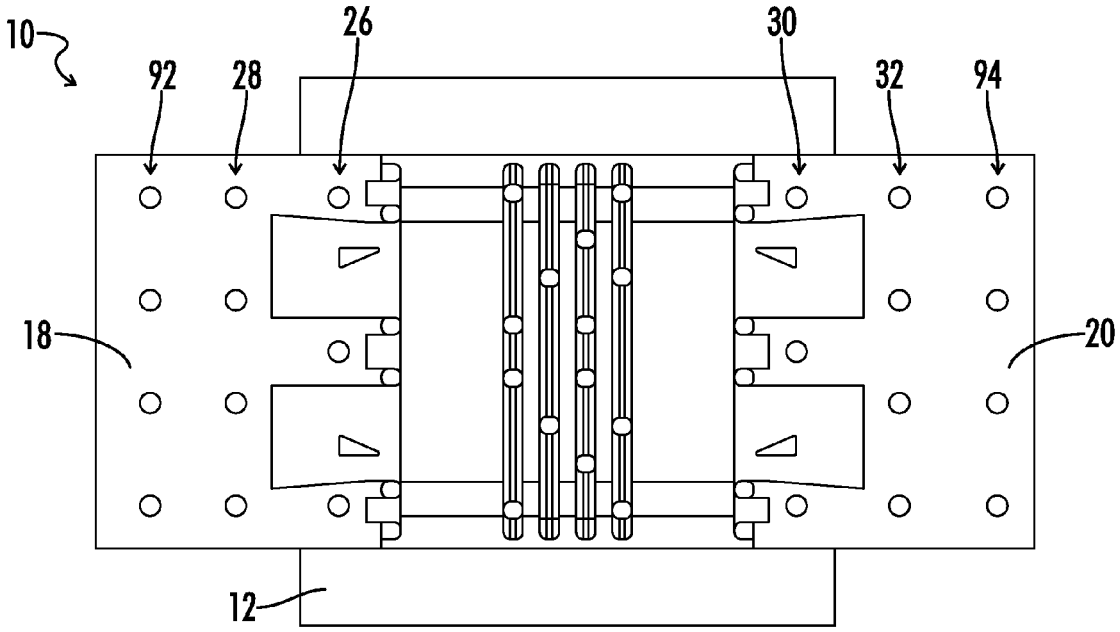
FIG. 7 is a bottom view of an embodiment of a magnetic component apparatus according to the present invention having additional pin rows.

FIG. 7 shows how additional pin rows can be added to magnetic component apparatus 10 of FIG. 1 to increase the number of pins located on first and second pin rails 18 and 20. A fifth pin row 92 can be added to first pin rail 18, and a sixth pin row 94 can be added to the second pin rail 20. Fifth and sixth pin rows 92 and 94 can further add pins to the first and second pin rails 18 and 20 while still minimizing the overall size and cost of magnetic component apparatus 10.

Figure 8:
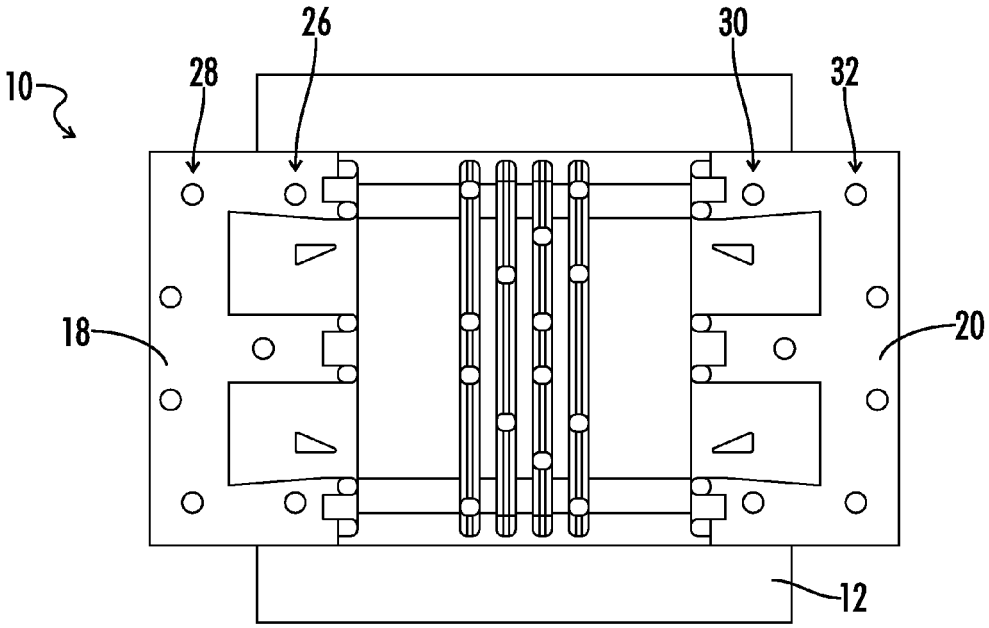
FIG. 8 is a bottom view of an embodiment of a magnetic component apparatus according to the present invention including pin rows having staggered pins.

In some embodiments the individual pins in each pin row can be oriented substantially linearly to one another, as shown in FIG. 5. In other embodiments, the individual pins in each pin row can be offset from one another such that pins are in a staggered configuration, as shown in FIG. 8. Such a configuration of the pins may provide better access to the pins for the breakout wires of plurality of windings 34.

Figure 9:
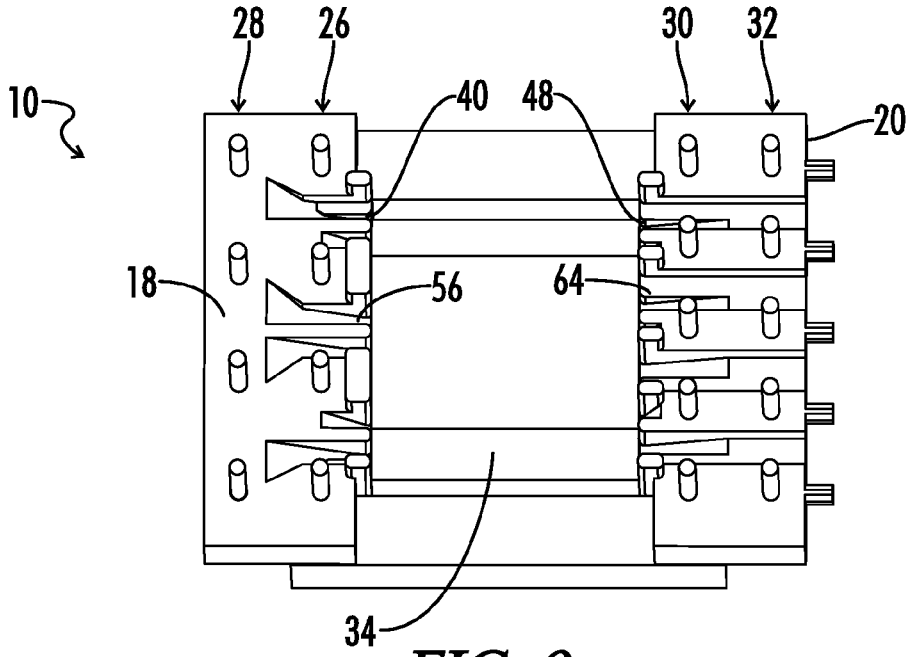
FIG. 9 is a bottom side perspective view of another embodiment of a magnetic component apparatus according to the present invention.
Figure 10:
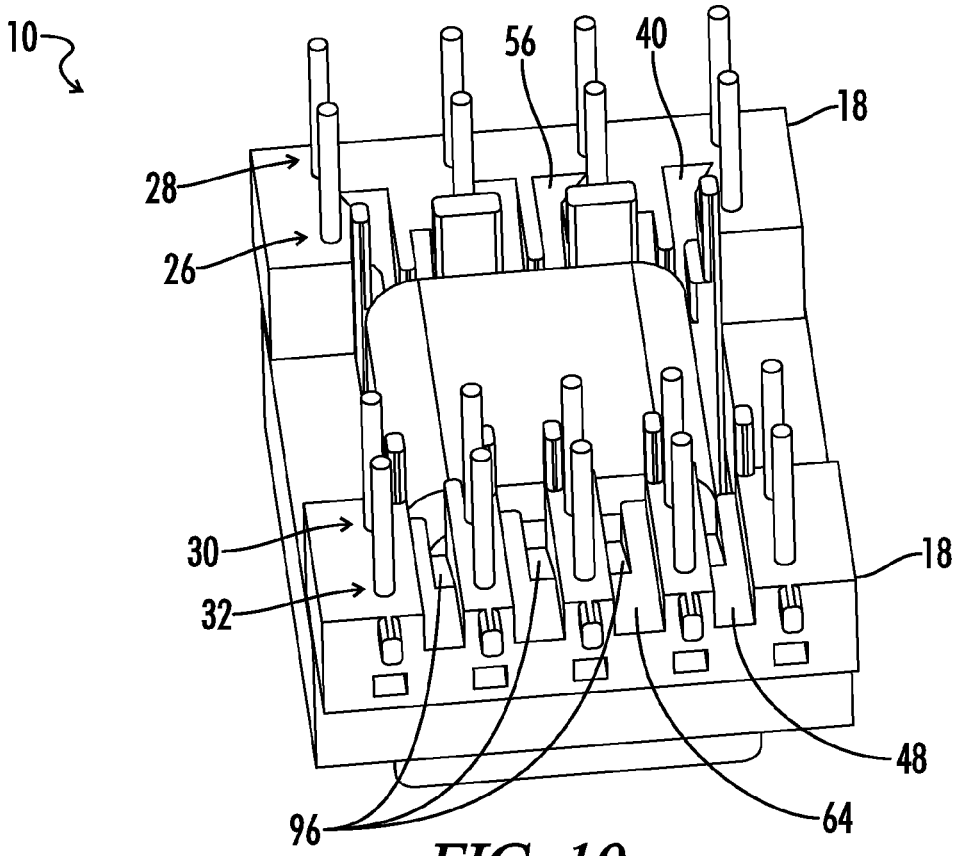
FIG. 10 is a bottom end perspective view of the magnetic component apparatus of FIG. 9.

A bottom side perspective view of a second embodiment of the present invention is shown in FIG. 9 and FIG. 10. This embodiment is similar to the embodiment of FIG. 1 in many respects. However, the second embodiment has a larger number of pins overall. Each of the first and second pin rows 26 and 28 has four pins, and each of the third and fourth pins 30 and 32 has five pins in this embodiment. As such, more wire guide channels are defined in the first and second pin rails 18 and 20. Additionally, the wire guide channels defined in the second pin rail 18 are clearance channels.

The windings 34 in the second embodiment include a single multi-layered winding disposed about bobbin body 16. As such, the second embodiment does not include one or more central flanges 36 as none are needed.

As shown in FIG. 10, a separate wire guide channel is defined in the first pin rail 18 for each of the individual pins on the second pin row 28. Additionally, instead of dividers 42 to separate multiple windings in the same wire guide channel, the wire guide channels in the second embodiment of magnetic component 10 have multiple tiers 90 that can help separate wires in the wire guide channels. Different wires can be located on different tiers 90 to keep the wires separate.

Thus, although there have been described particular embodiments of the present invention of a new and useful MAGNETIC COMPONENT WITH MULTIPLE PIN ROW BOBBIN it is not intended that such references be construed as limitations upon the scope of this invention except as set forth in the following claims.

What is claimed is:

1. A magnetic component apparatus comprising:

a core;

a bobbin comprising:

a bobbin body, the bobbin body having a first end and a second end, having a longitudinal axis, and having a passage extending through the bobbin body from the first end to the second end along the longitudinal axis;

a first pin rail fixed to the first end of the bobbin body and extending outward in a first direction away from the bobbin body, the first direction parallel to the longitudinal axis, the first pin rail having a first inner side directed toward the second end of the bobbin body and having a first lower side, the first lower side facing away from the passage in a direction perpendicular to the first direction, the first lower side substantially transverse to the longitudinal axis; and a second pin rail fixed to the second end of the bobbin body and extending outward in a second direction away from the bobbin body, the second direction parallel to the longitudinal axis and opposite the first direction, the second pin rail having a second inner side directed toward the first end of the bobbin body and having a second lower side, the second lower side facing away from the passage in a direction perpendicular to the second direction, the second lower side substantially transverse to the longitudinal axis;

a first pin row located on the first pin rail, the first pin row comprising a first plurality of straight pins, each pin in the first pin row extending perpendicularly from the first lower side of the first pin rail, each pin in the first pin row displaced at least a first distance from the first inner side of the first pin rail;

a second pin row located on the first pin rail, the second pin row comprising a second plurality of straight pins, each pin in the second pin row extending perpendicularly from the first lower side of the first pin rail, each pin in the second pin row displaced at least a second distance from the first inner side of the first pin rail, the second distance greater than the first distance such that the second pin row is located at a longitudinally exterior position with respect to the first pin row;

a third pin row located on the second pin rail, the third pin row comprising a third plurality of straight pins, each pin in the third pin row extending perpendicularly from the second lower side of the second pin rail, each pin in the third pin row displaced at least a third distance from the second inner side of the second pin rail; and a plurality of windings located on the bobbin body between the first and second pin rails.

2. The apparatus of claim 1, wherein the plurality of pins in the first pin row comprises at least three pins, and the plurality of pins in the second pin row comprises at least four pins.

3. The apparatus of claim 1, further comprising a fourth pin row, the fourth pin row comprising a plurality of straight pins, each pin in the fourth pin row extending perpendicularly from the second lower side of the second pin rail, each pin in the fourth pin row displaced at least a fourth distance from the second inner side such that the fourth pin row is located at a longitudinally exterior position with respect to the third pin row on the second pin rail.

4. The apparatus of claim 3, wherein the plurality of pins in the third pin row includes at least three pins and the plurality of pins in the fourth pin row includes at least four pins.

5. The apparatus of claim 1, wherein a first wire guide channel is defined in the first inner side and the first lower side of the first pin rail, the first wire guide channel extending between pins in the first pin row and extending toward the second pin row.

6. The apparatus of claim 5, further comprising:

a fourth pin row, the fourth pin row comprising a plurality of straight pins, each pin in the fourth pin row extending perpendicularly from the second lower side of the second pin rail, each pin in the fourth pin row displaced at least a fourth distance from the second inner side such that the fourth pin row is located at a longitudinally exterior position from the third pin row on the second pin rail; and a second wire guide channel defined in the second inner side and the second lower side of the second pin rail, the second wire guide channel extending between pins of the third pin row and extending toward the fourth pin row.

7. The apparatus of claim 6, wherein:

the first pin row further includes a first pin, a second pin, and a third pin;

the first wire guide channel extends between the first and second pins and extends toward the second pin row; and a third wire guide channel is defined in the first inner side and the first lower side of the first pin rail, the third wire guide channel extending between the second and third pins and extending toward the second pin row.

8. The apparatus of claim 7, wherein:

the third pin row of the second pin rail further includes a fourth pin, a fifth pin, and a sixth pin;

the second wire guide channel extends between the fourth and fifth pins and extends toward the fourth pin row; and a fourth wire guide channel is defined in the second inner side and the second lower side of the second pin rail, the fourth wire guide channel extending between the fifth and sixth pins and extending toward the second pin row.

9. The apparatus of claim 1, wherein a first wire guide groove is defined in the first inner side and the first lower side of the first pin rail, the first wire guide groove extending toward the first pin row.

10. The apparatus of claim 9, wherein a second wire guide groove is defined in the second inner side and the second lower side of the second pin rail, the second wire guide groove extending towards the third pin row.

11. The apparatus of claim 1, wherein the bobbin body further comprises one or more central flanges.

12. The apparatus of claim 11, wherein the one or more central flanges include a plurality of winding guide posts.

13. The apparatus of claim 1, wherein the first inner side of the first pin rail and the second inner side of the second pin rail include a plurality of wire guide posts, wherein at least a portion of each wire guide post of the first inner side extends perpendicularly from the first lower side, and wherein at least a portion of each wire guide post of the second inner side extends perpendicularly from the second lower side.

14. A magnetic component apparatus comprising:

a bobbin comprising:

a bobbin body, the bobbin body having a first end, a second end, a longitudinal axis, and a passage extending through the bobbin body from the first end to the second end along the longitudinal axis;

a first pin rail fixed to the first end of the bobbin body and extending outward in a first direction away from the bobbin body, the first direction parallel to the longitudinal axis, the first pin rail having a first inner side directed toward the bobbin body and having a first lower side, the first lower side facing away from the passage and substantially transverse to the longitudinal axis; and a second pin rail fixed to the second end of the bobbin body and extending outward in a second direction from the bobbin body, the second direction parallel to the longitudinal axis and opposite the first direction, the second pin rail having a second inner side directed toward the bobbin body and having a second lower side, the second lower side facing away from the passage and substantially transverse to the longitudinal axis;

a first pin row located on the first pin rail, the first pin row comprising a first plurality of straight pins, each pin in the first pin row extending perpendicularly from the first lower side of the first pin rail, each pin in the first pin row displaced at least a first distance from the first inner side of the first pin rail;

a second pin row located on the first pin rail, the second pin row comprising a second plurality of straight pins, each pin in the second pin row extending perpendicularly from the first lower side of the first pin rail, each pin in the second pin row displaced at least a second distance from the first inner side of the first pin rail, the second distance greater than the first distance such that the second pin row is located at a longitudinally exterior position with respect to the first pin row;

a third pin row located on the second pin rail, the third pin row comprising a third plurality of straight pins, each pin in the third pin row extending perpendicularly from the second lower side of the second pin rail, each pin in the third pin row displaced at least a third distance from the second inner side of the second pin rail; and a plurality of windings on the bobbin body.

15. The apparatus of claim 14, wherein a wire guide channel is defined in the first inner side and the first lower side of the first pin rail, the wire guide channel extending between pins in the first pin row and extending toward the second pin row.

16. The apparatus of claim 14, further comprising a fourth pin row, the fourth pin row comprising a plurality of straight pins, each pin in the fourth pin row extending perpendicularly from the second lower side of the second pin rail, each pin in the fourth pin row displaced at least a fourth distance from the second inner side such that the fourth pin row is located at a longitudinally exterior position from the third pin row on the second pin rail.

17. The apparatus of claim 16, further comprising:

a first wire guide channel defined in the first inner side and the first lower side of the first pin rail, the first wire guide channel extending between pins of the first pin row and extending toward the second pin row; and a second wire guide channel defined in the second inner side and the second lower side of the second pin rail, the wire guide channel extending between pins of the third pin row and extending toward the fourth pin row.

18. A magnetic component comprising:

a core;

a bobbin comprising:

a bobbin body, the bobbin body having a first end, a second end, and a longitudinal passage extending through the bobbin body between the first end and the second end, the longitudinal passage receiving the core;

a first pin rail fixed to the first end of the bobbin, the first pin rail having a first inner side facing toward the bobbin in a first direction parallel to the longitudinal axis and having a first lower side facing away from the longitudinal passage, the first lower side substantially transverse to the longitudinal axis; and a second pin rail fixed to the second end of the bobbin, the second pin rail having a second inner side facing toward the bobbin in a second direction parallel to the longitudinal axis, the second direction opposite the first direction, the second pin rail having a second lower side facing away from the longitudinal passage, the second lower side substantially transverse to the longitudinal axis;

a first pin row comprising a first plurality of straight pins extending perpendicularly from the first lower surface of the first pin rail, each pin in of the first plurality of pins located at least a first distance from the first inner side of the first pin rail;

a second pin row comprising a second plurality of straight pins extending perpendicularly from the first lower surface of the first pin rail, each pin of the second plurality of pins located at least a second distance from the first inner side of the first pin rail, the second distance greater than the first distance such that the second pin row is located at a longitudinally exterior position with respect to the first pin row on the first pin rail;

at least a third pin row comprising a third plurality of substantially straight pins extending perpendicularly from the second lower surface of the second pin rail;

a plurality of windings on the bobbin body; and a printed circuit board electrically connected to the pins of the first, second, and third pin rows.

19. The apparatus of claim 18, wherein a first wire guide channel is defined in the first inner side and the first lower side of the first pin rail, the first wire guide channel extending between pins of the first pin row and extending toward the second pin row.

20. The apparatus of claim 18, wherein a first wire guide groove is defined in the first inner side and the first lower side of the first pin rail, the first wire guide groove extending toward the first pin row.

* * * * *